US008747620B2

(12) United States Patent
Nilsson et al.

(10) Patent No.: US 8,747,620 B2
(45) Date of Patent: Jun. 10, 2014

(54) CELLULOSIC PULP MOULD COMPRISING AN IMPERMEABLE OUTER SURFACE

(75) Inventors: Björn Nilsson, Kimstad (SE); Leif Båskman, Norrköping (SE); John Shand, Norsholm (SE)

(73) Assignee: Pakit International Trading Company Inc., Saint Michael (BB)

( * ) Notice: Subject to any disclaimer, the term of this patent is extended or adjusted under 35 U.S.C. 154(b) by 0 days.

(21) Appl. No.: 13/509,515

(22) PCT Filed: Nov. 12, 2010

(86) PCT No.: PCT/SE2010/051250

§ 371 (c)(1),
(2), (4) Date: Aug. 21, 2012

(87) PCT Pub. No.: WO2011/059393

PCT Pub. Date: May 19, 2011

(65) Prior Publication Data

US 2012/0305210 A1 Dec. 6, 2012

(30) Foreign Application Priority Data

Nov. 13, 2009 (SE) ..... 0950861

(51) Int. Cl.
*D21F 13/00* (2006.01)
*C09J 5/00* (2006.01)

(52) U.S. Cl.
USPC ..... 162/382; 162/383; 162/411; 162/416; 162/218; 162/226

(58) Field of Classification Search
USPC ..... 425/547–548
See application file for complete search history.

(56) References Cited

U.S. PATENT DOCUMENTS

| | | | | |
|---|---|---|---|---|
| 2,831,951 | A * | 4/1958 | Desloge | 338/241 |
| 6,352,617 | B1 * | 3/2002 | Lee | 162/348 |
| 2005/0063856 | A1 * | 3/2005 | Miyasaka | 419/1 |
| 2005/0072955 | A1 * | 4/2005 | Takahashi et al. | 252/62.62 |
| 2005/0150624 | A1 * | 7/2005 | Toh et al. | 162/218 |
| 2009/0127730 | A1 * | 5/2009 | Zenpo et al. | 264/28 |
| 2009/0134308 | A1 * | 5/2009 | van der Eerden et al. | 249/137 |
| 2009/0139678 | A1 * | 6/2009 | Nilsson et al. | 162/226 |

FOREIGN PATENT DOCUMENTS

| | | |
|---|---|---|
| WO | WO 2006057609 | 6/2006 |
| WO | WO 2006057611 | 6/2006 |

OTHER PUBLICATIONS

International Search Report filed in PCT/SE2010/051250; mailed Feb. 11, 2011.

* cited by examiner

*Primary Examiner* — Philip Tucker
*Assistant Examiner* — Eric Yaary
(74) *Attorney, Agent, or Firm* — Jeffrey S. Melcher; Manelli Selter PLLC

(57) ABSTRACT

A pulp mould, comprising a porous sintered body (11) having an outer surface (13) and an inner surface (12), wherein a portion (11B) of said mould comprises an area (16) at its outer periphery provided with means (16A; 47) integrated during sintering to achieve impermeability of said outer area (16).

13 Claims, 7 Drawing Sheets

CELLULOSIC PULP MOULD COMPRISING AN IMPERMEABLE OUTER SURFACE

RELATED APPLICATIONS

This application is a national phase application of international application number PCT/SE2010/051250, titled "Cellulosic Pulp Mould Comprising an Impermeable Outer Surface," filed on Nov. 12, 2010, which claims priority to Swedish patent application number 0950861-5 filed on Nov. 13, 2009. The present application claims priority to the foregoing applications and incorporates herein by reference in their entirety the content of the foregoing applications.

TECHNICAL FIELD

The present disclosure describes a pulp mould comprising a porous sintered body and a portion of the mould that is impermeable.

BACKGROUND

Packagings of moulded pulp are used in a wide variety of fields and provide an environmental friendly packaging solution that is biodegradable. Products from moulded pulp are often used as protective packagings for consumer goods like for instance cellular phones, computer equipment, DVD players as well as other electronic consumer goods and other products that need a packaging protection. Furthermore moulded pulp objects can be used in the food industry as hamburger shells, cups for liquid content, dinner plates etc. Moreover moulded pulp objects can be used to make up structural cores of lightweight sandwich panels or other lightweight load bearing structures. The shape of these products is often complicated and in many cases they have a short expected time presence in the market. Furthermore the production series may be of relative small size, why a low production cost of the pulp mould is an advantage, as also fast and cost effective, way of manufacturing a mould.

In traditional pulp moulding lines, se for example U.S. Pat. No. 6,210,531, there is a fibre containing slurry which is supplied to a moulding die, e.g. by means of vacuum. The fibres are contained by a wire mesh applied on the moulding surface of the moulding die and some of the water is sucked away through the moulding die commonly by adding a vacuum source at the bottom of the mould. Thereafter the moulding die is gently pressed towards a complementary female part and at the end of the pressing the vacuum in the moulding die can be replaced by a gentle blow of air and at the same time a vacuum is applied at the complementary inversed shape, thereby enforcing a transfer of the moulded pulp object to the complementary female part. In the next step the moulded pulp object is transferred to a conveyor belt that transfers the moulded pulp object into an oven for drying.

Conventional pulp moulds which are used in the above described process are commonly constructed by using a main body covered by a wire mesh for the moulding surface. The wire mesh prevents fibres to be sucked out through the mould, but letting the water passing out. The main body is traditionally constructed by joining aluminium blocks containing several drilled holes for water passage and thereby achieving the preferred shape. The wire mesh is commonly added to the main body by means of welding. This is however complicated, time consuming and costly. Furthermore the grid from the wire mesh as well as the welding spots is often apparent in the surface structure of the resulting product giving an undesirable roughness in the final product. Furthermore the method of applying the wire mesh sets restrictions of the complexity of shapes for the moulding die making it impossible to form certain configurations in the shape.

WO2006057610 describes another kind of pulp moulding lines where the product is formed on a forming tool and subsequently pressed under heat and vacuum suction in a number of pressing steps. The product is thereafter dried in a microwave oven and ready for post treatment processes. A mould suitable for such pulp moulding lines was shown in WO2006057609. The moulding surface can be heated to 200° C. and above through a heat plate arranged to the bottom of the mould. The heat plate comprises a number of drilled holes which connects the mould to a vacuum box at the opposite side of the heat plate. However drilling holes in the heat plate may be costly and also lead to undesired waste of material. Another problem is that a lot of energy is needed to heat the moulding surfaces, via the heating plate.

Another kind of problem related to the tool design as presented in WO2006057609/10 is that the design of the pulp mould and also their production present some steps/features that imply high cost and/or undesired side effects.

OBJECTS OF THE INVENTION

It is an object of the invention to provide a high quality pulp mould which is comparably cost effective to produce.

It is another object of the invention to provide a pulp mould that can be produced in a time efficient manner.

It is another object of the invention to provide a pulp mould whith comparably low amounts of energy to heat the moulding surface.

It is another object of the invention to provide a pulp mould that can be produced at low amounts of rest materials.

Further aspects of the invention will be apparent from the following.

SUMMARY OF THE INVENTION

At least one of the above stated objects and/or problems is solved by a pulp mould and/or method as defined by the independent claims.

Thanks to the invention there is achieved a pulp mould and also a tool, partly thanks to the new pulp mould which may be produced in a much more cost efficient manner, which also will require less energy during its intended use and which may in an improved manner provide high quality pulp products.

DETAILED DESCRIPTION OF THE INVENTION

In the forthcoming text when using directional terms such as upper or lower in relation to a pulp mould, the moulding surface of the pulp mould is seen as the top and the base plate as the bottom.

Figure 1:
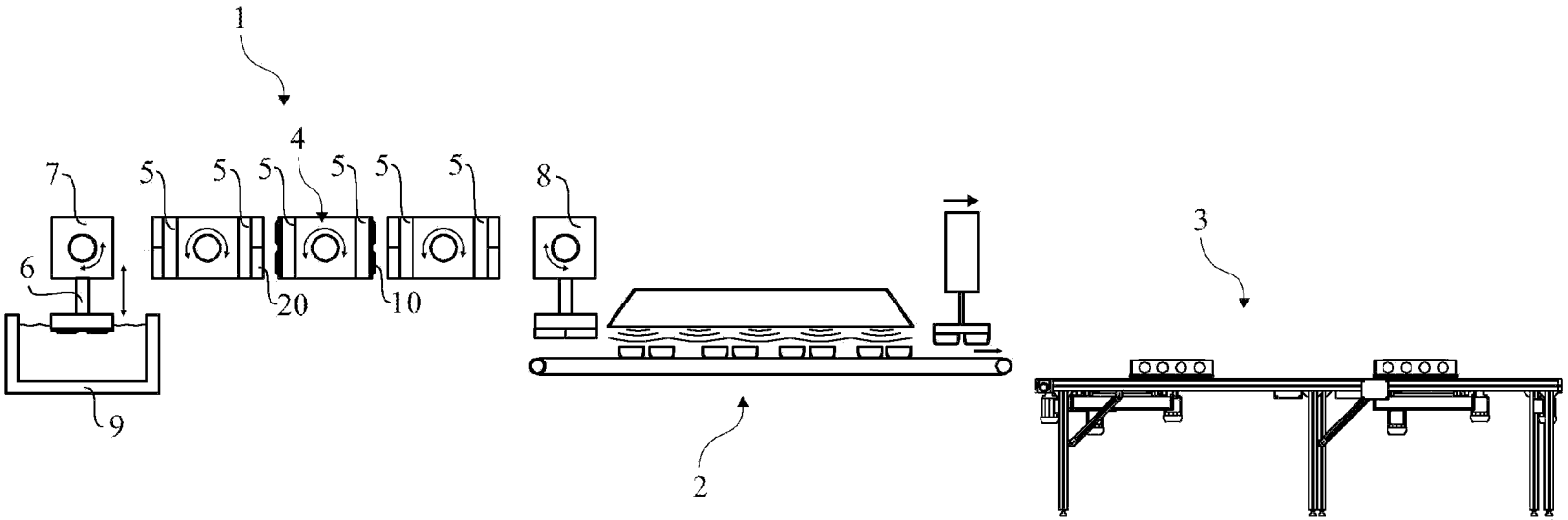
FIG. 1 shows a schematic view of a manufacturing process of a moulded fibrous product according to the invention.

FIG. 1 is a schematic view of a manufacturing process for producing moulded fibrous products showing a forming section 1 for forming a moulded pulp object, a drying section 2 for drying the moulded pulp object, and a after treatment section 3 for subjecting the dried moulded pulp object to after treatment steps such as lamination, finishing the edges of the pulp objects, packing the pulp objects, etc. The forming section 1 includes a plurality of rotatable holders 4, each having two opposite located tool carriers 5. The holder 4 alternately have female 20 or male 10 pulp mould(s) mounted on the tool carriers 5, e.g. if the first holder has male moulds then the second holder has female moulds, and the third holder male moulds etc. The tool carrier 5 can be pushed out and pulled in, in relation to the holder 4, thereby enabling the opposing moulds to mate each other during operation. The means for pushing and pulling the tool carriers 5 can e.g. include a telescoping hydraulically operated arm 6.

During operation, the pulp mould(s) 10 of the first holder 7 is immersed in the stock that is kept in the tank 9 to form a fibre object(s) on the pulp mould(s). The fibre object(s) is subsequently dewatered between opposing pairs of pulp moulds 10, 20 of the holders 4, till it is passed to the drying section 2 by the last holder 8. The dewatering between opposing pairs of pulp moulds 10, 20 is performed by pushing opposing tool carriers 5 with their female respectively male moulds against each other as is described in more detail in WO 2006057609/10, which are herewith introduced by means of reference. The dewatering operations are preferably performed under suction and heat. The first 7 and the last holder 8 rotate 90 degrees back and forth during operation, while the intermediate holders each rotate 180 degrees so that the fibre object(s) can be passed from the pulp mould(s) of the first holder 7, to the pulp mould(s) of the second, and so on till the last holder 8. The handover of the fibre object(s) between an opposing pair of pulp moulds 10, 20 can be done by releasing the suction through the delivering pulp mould(s) 10, 20, and optionally give it a gentle blow, while suction is applied through the receiving pulp mould(s) 20, 10.

The facing surfaces of opposing pulp moulds 10, 20 have complementary shapes with regard to the moulding surfaces thereof, however other characteristics of the moulds may differ depending on the positional order of the moulds, for instance the mould(s) of the first holder 7 may have a coarser structure of its moulding surfaces, than the opposing mould (s) of the second holder 4, and subsequent moulds 20, 10 of the following holders may have finer and finer surface structures. Further the suction means and/or the heating means may also vary between the holders, e.g. the pulp mould of the first holder 7 may have suction means but lack heating means.

Figure 2:
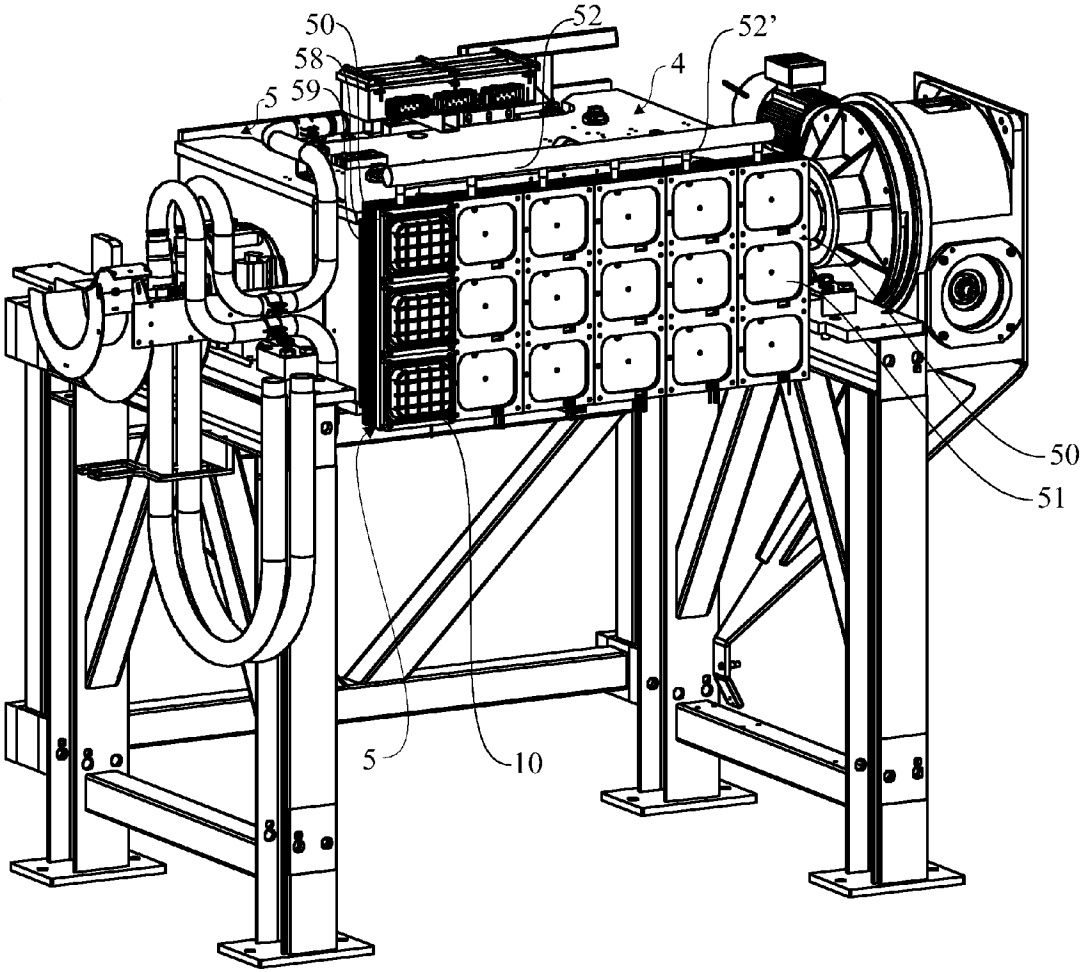
FIG. 2 shows a perspective view of the formation and pressing tools.

FIG. 2 shows a holder 4 positioned in its support structure and related sub equipment, which will not be described in greater detail, e.g. means for rotating the holder around its axis, and means pushing and pulling the tool carrier 5 outwards and inwards. On the holder 4 there are arranged two tool carriers 5, presenting some features of one embodiment according to the invention. The tool carrier 5 here shown has six columns, where each column can hold three pulp moulds, here exemplified by male pulp moulds 10 at the first column, while the remaining columns are shown only with the base plate 50 having chambers 51 onto which a female 20 or a male 10 pulp mould can be mounted. The two carrier 5 also comprise the following; next to the backside of the base plate 50 a layer of insulation 58 and on the opposing side in relation to the base plate 50 a carrier plate 59. Along one side and of the tool carrier 5 there is arranged vacuum pipe 52 that extends substantially along the whole length of the tool carrier 5. From the vacuum pipe 52 there is arranged a branch pipe 52' connected to each row of tool plates 50, to provide for vacuum in each one of the vacuum chambers 51, which will be described in more detail below. Accordingly the vacuum pipe 52 is fixedly attached to the tool carrier 5, necessitating a flexible connection (not shown) to the vacuum pump to enable the desired movement of the tool carrier 5.

Figure 3:
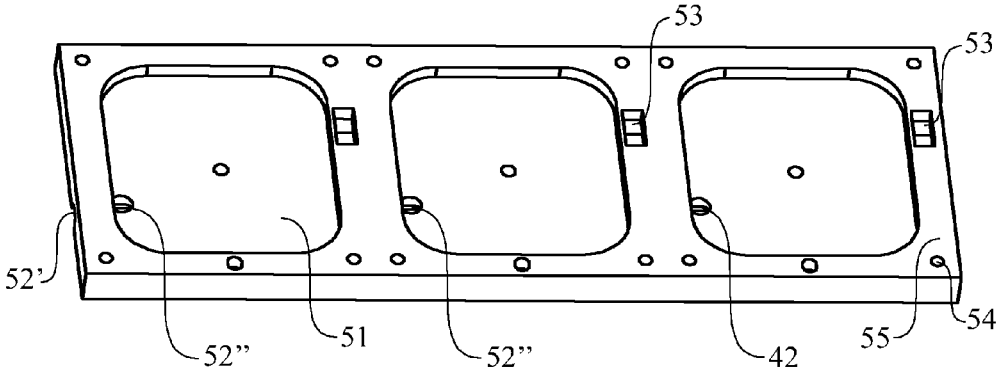
FIG. 3 shows a perspective view of the front part of a base plate of a formation tool according to the invention.

In FIG. 3 there is shown in a perspective view, and in greater detail, one of the tool plates 50 presented in FIG. 2. The tool plate 50 is arranged with a number of holes 54 for attachment of moulds 10, 20 e.g. three moulds. For each mould 10/20 there is arranged a centrally positioned recess 51 forming the vacuum chamber for each mould 10/20. The extension of the vacuum chamber 51 is in general as large as possible, considering the fact that there is a need of a surrounding support surface 55 to safely attach and seal along the attachment area of the mould. Also in connection with each vacuum chamber 51 there is a vacuum outlet 52" leading to a channel 52' connecting each vacuum chamber 51 with the vacuum pipe 52. Moreover there are passages 53 for connection of electricity and preferably also sensors for each one of the moulds 10/20. The tool plate 50 could be produced in almost any kind of material, but is preferable made from some kind of light weight material having good ability to fulfill all needs, e.g. aluminum.

Figure 4:
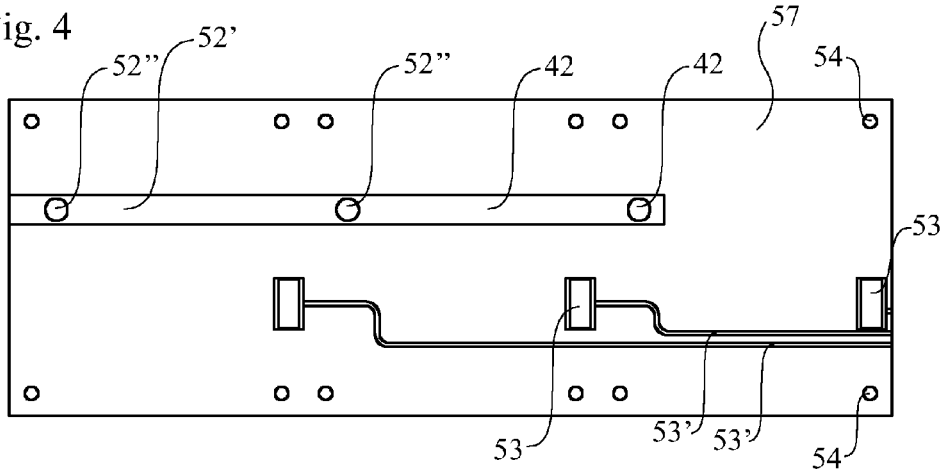
FIG. 4 shows a view from behind of said base plate.
Figure 5:
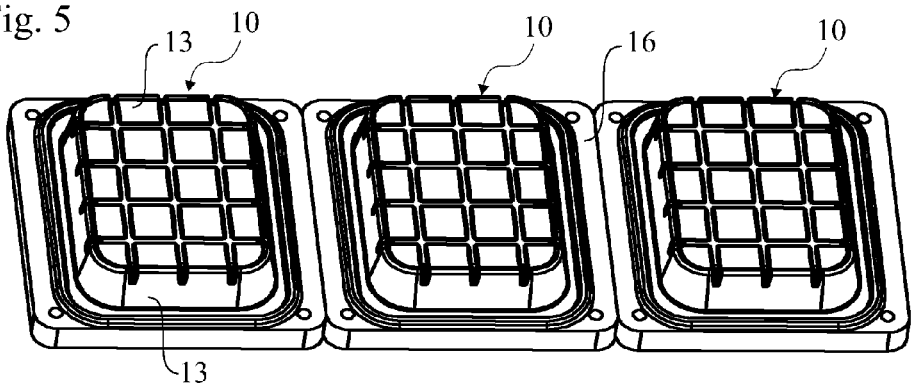
FIG. 5 shows a perspective view from above of a male pulp mould according to the invention.

In FIG. 4 there is shown the backside of a tool plate 50. Here the connecting vacuum channel 52' is clearly presented, in the form of channel in the back of the plate 50. Also small channels 53' are provided for electric cables (not shown) to the electrical contacts (and possible sensor/s 48, see FIG. 8) intended for fitting into the passages 53. In FIG. 5 there is shown a set of three male moulds 10 intended for interfit with a tool plate 50 as described in relation to FIGS. 3 and 4. Each mould 10 is arranged with a moulding surface 13 that is porous to enable vacuum to pass through. Further there is a support part 16 surrounding the moulding surface area 13 which support part presents impermeable areas 16. The interfit between the tool plate 50 and the mould 10/20 will be described more in detail in relation to FIG. 8.

Figure 6:
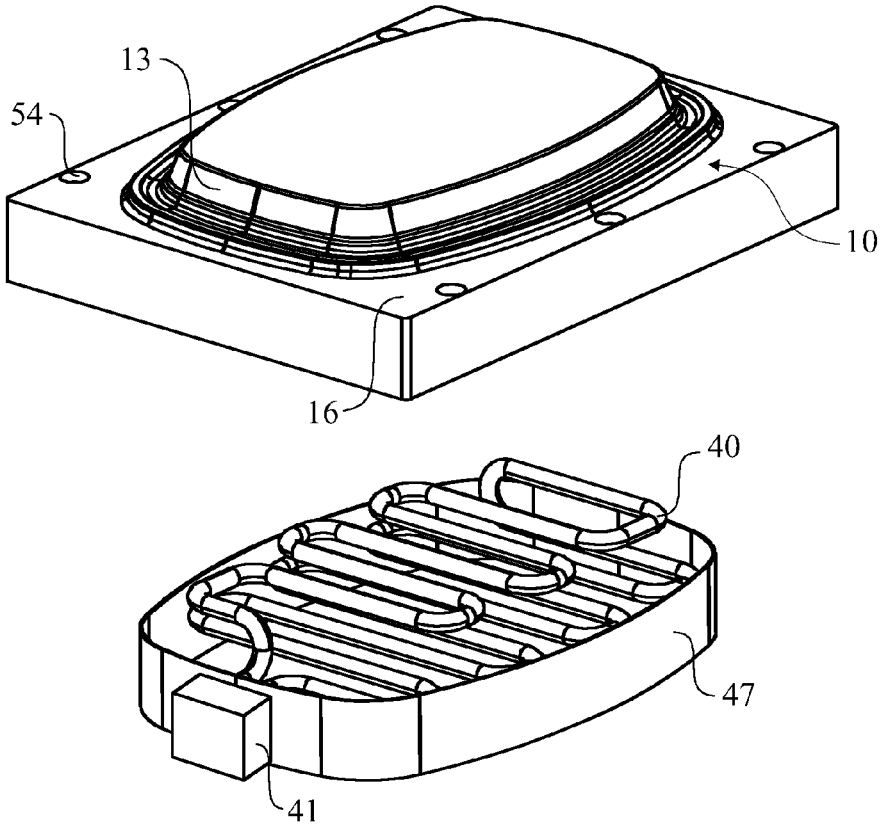
FIG. 6 shows a partly exploded view in perspective of one male pulp mould according to the invention
Figure 6A:
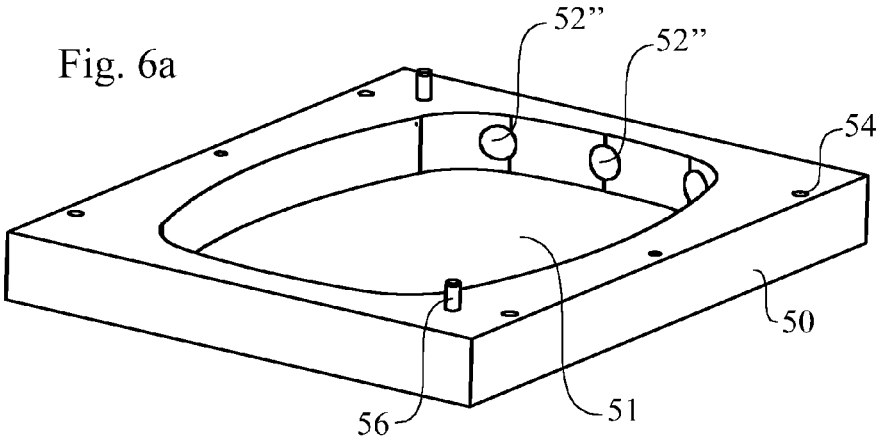
FIG. 6A shows an exemplary embodiment of a single base plate according to the invention.
Figure 7:
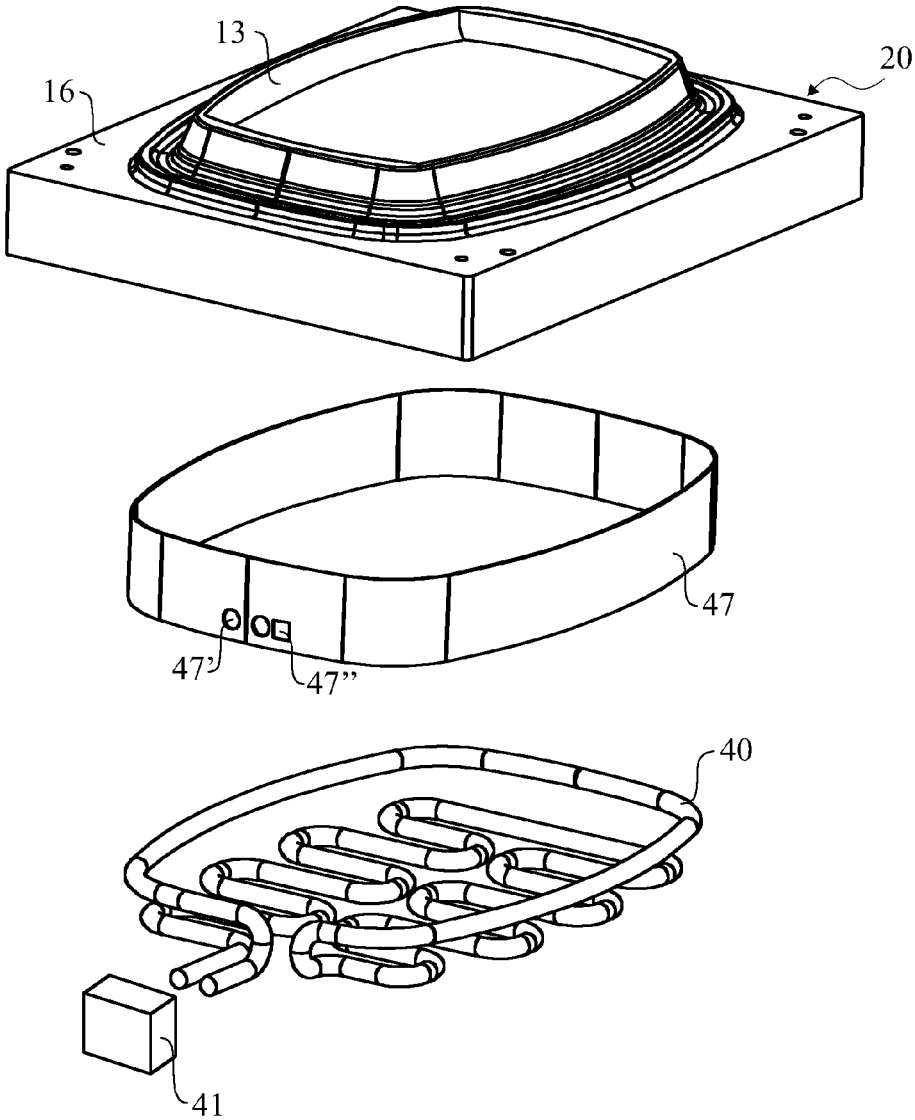
FIG. 7 shows an exploded view of a female pulp mould according to the invention.

In FIGS. 6 and 7 there are shown exploded views of male pulp mould 10 and a female mould 20, respectively, according to the one embodiment of invention. As is evident for a skilled person the same inventive features are of course applicable to both the male and female moulds. The mould 10/20 forms an integral body 11 (see FIG. 8) wherein a heating coil 40 and a sealing barrier 47 are built in, in connection with sintering of the mould 10/20. In the sealing barrier 47 there are formed holes 47', 47" of corresponding size and form as the cross-section of the element (heating wire and/or sensor body) intended to pass through. Further there is an interface unit 41 for connecting the heating means 40 and also possibly a sensor. FIG. 6A shows a perspective view of a pulp plate 50 intended to merely carry one mould 10/20. The main purpose of this figure is to present that indeed there are a big variety of the modifications within ambit of the invention, e.g. merely have one mould on top of each base plate 50. Also this figure presents a different solution for providing vacuum to the vacuum chamber 51, which is achieved by drilled holes 52' leading into the vacuum chamber 51 via appropriate connecting channels 52 (not shown), e.g. branch pipes 52' leading to a common vacuum pipe 52. Further it is shown that there are positioning pins 56 intended to facilitate fitting of the mould 10/20 onto the base plate 50. Moreover it is presented that the base plate 50 may be formed to have a vacuum chamber 51 in the form of through passage and accordingly then use backing plate in connection with the insulating layer at the back of the base plate 50, to provide for reliable sealing and support.

Figures 8, 8A:
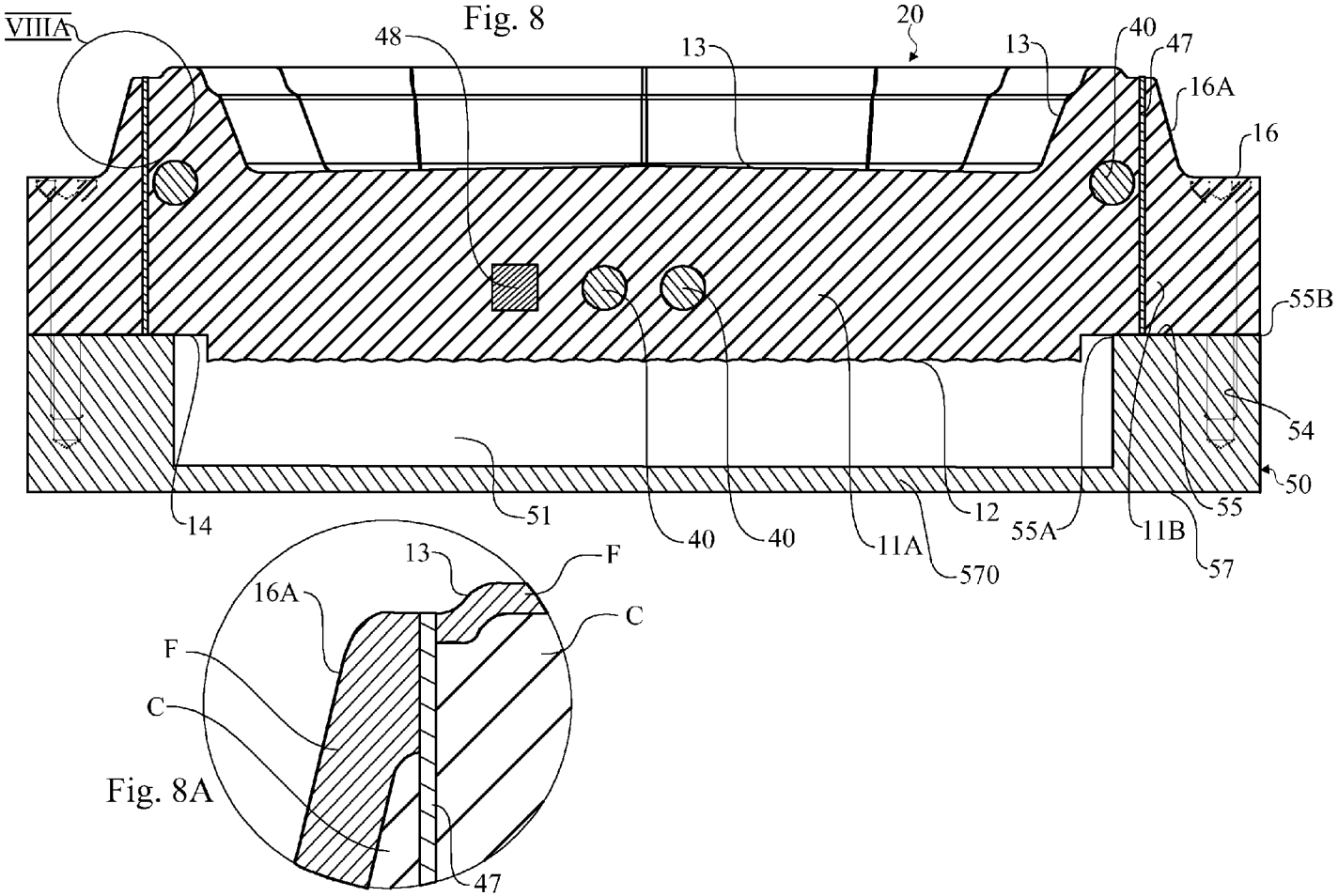
FIG. 8 presents a cross sectional view of pulp mould and base plate according to the invention.

FIG. 8 presents a cross sectional view through a female pulp mould 20 being attached to a tool plate 50, in accordance with the invention. It is shown that the sealing stripe 47 is arranged within said outer area 16 or between said outer area 16 and a central portion 11A of said porous body 11.

In the following the details of the inventions will be described with reference to a mixture of FIGS. 6-11. The pulp mould 10 includes a porous body 11 with an inner permeable surface 12 and an outer permeable moulding surface 13. The porous body 11 is preferably a loose sintered body from metal powder. In particular copper based powders, preferably bronze powders have been shown to provide very good results. The porous body 11 may be of metal particles of the similar sizes throughout the body 11 or be layered by powder of different size and/or content, to fulfil different needs and mostly having a finer powder at the outer moulding surface. (Regarding the sintering it is referred to the WO-document referenced above.)

Figure 10:
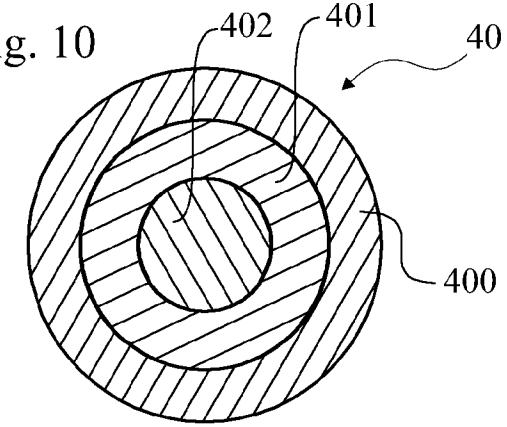
FIG. 10 shows a first embodiment of a cross section of the heating element as shown in FIG. 9.
Figure 11:
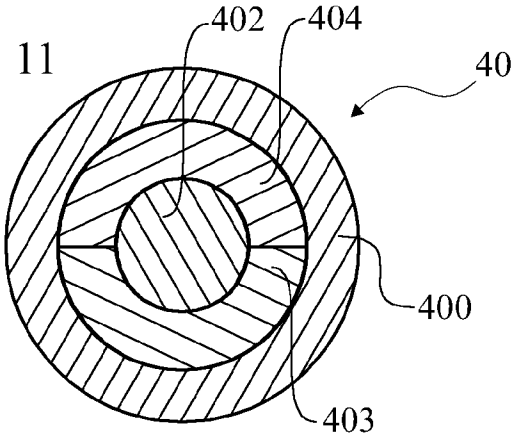
FIG. 11 shows a further embodiment of said heating element.

The pulp mould 10 includes a heating means 40, preferably in the form of resistor heating coils 40 commonly used in electrical stoves. The heating coils have an inner core 402 (see FIG. 10) which is heated by means of electrical resistance. An intermediate layer 401 surrounds the inner core 402. Preferably the intermediate layer 401 is electrically non conductive, but is a good heat conductor for transferring heat to the porous body 11. However, as indicated in FIG. 11 the intermediate layer may comprise an upper portion 404 and lower portion 403, where the upper portion 404 is in a material that is a much better heat conductor than the lower portion 403 which forms an heat insulator, so that heat is directed towards the moulding surface 13. An outer layer 400 preferably of a metallic material surrounds the intermediate layer 401. The outer layer 400 is sintered to the porous body, forming sintering necks to the particles of the porous body 11 which provides for a good heat transfer to the porous body 11.

Since the pulp mould 10/20 will be heated during use it is desirable that the heating coefficient of the powder particles and the material of the outer layer 400 are similar. When using bronze powder in the body it has been shown that copper or a copper based alloy is a good material for the outer layer 400. Copper and bronze can also be sintered at much lower temperature than steel powder in connection with steel heating elements 40; however such a combination may also be possible. The cross-section of the resistor heating coils 40 can be circular as shown in FIGS. 10 and 11, however the cross-section could very well be rectangular or having any other kind of cross-sectional shapes.

FIGS. 6 and 7 present that there is preferably a sealing stripe 47 arranged in the mould 10/20, preferably made in copper to provide a seal between the permeable area (including the outer moulding surface 13) and the area 16 where it is desired not having the mould permeable to vacuum. Accordingly in a preferred embodiment both the heating element 40 and the sealing stripe 47 are positioned into the basic mould (not shown) in connection with the production of the pulp mould 10/20 by means of sintering. When using bronze powder in the body it has been shown that copper or a copper based alloy is a good material for the sealing stripe 47; however other alloys may also be used as the material for sealing stripe 47.

As is evident from the cross section shown in FIG. 8 the heating means 40 and also the sealing stripe 47 will be integrated/embedded into the body 11 of the mould 20. A novel feature presented in FIG. 8 is the use of a limited surrounding machined rear surface 14 of the mould. This rear surface 14 is the only part of the inner moulding surface 12 that is machined after sintering. Accordingly merely a sufficient area is machined to allow for appropriate interfit onto the support surface 55 of the tool plate 50.

Thanks to this arrangement a number of advantages are gained. Firstly it means that merely a minor fraction of the material used in connection with sintering will be wasted, compared to the traditional manner where the whole backside of the mould 20 would be machined to make it flat. Further it will allow for better permeability of the inner surface 12 of the mould, due to the fact that machining will negatively affect that surface by at least partly blocking the pores at the surface 12.

Also the use of sealing stripe 47 will provide considerable advantages. The stripe 47 in an efficient manner seals the outer portion surface 16 of the mould 20 that otherwise will have to be sealed in some other manner that have shown to be either costly and/or not totally reliable. Further it implies that the holes 54 or the screws connecting the mould 20 with the tool plate 50 is also sealed off in an efficient manner, due to positioning the sealing stripe 47 closer to the inner edge 55A of the supporting surface 55 than the outer edge 55B, thereby providing a relatively wide area adjacent the periphery of the mould 20 for the holes 54.

Another evident advantage with the principles of the novel features is that the arrangement of vacuum supply to the vacuum chambers 51 may be achieved in a very compact and cost efficient manner, by integrating the connecting channels 52', 52" directly into the tool plate 50. As is evident from FIG. 8 and also FIG. 2, this leads to a very compact arrangement.

As depicted in FIG. 8A, which is a partial cross sectional area including the sealing stripe 47 the part 11B of the mould comprising the surface 16A not intended to be permeable may adjacent the surface thereof be provided with a thicker layer of finer powder particles F to thereby provide extra safety to have it impermeable, i.e. a sufficiently thick layer of fine particles F such that impermeability achieved, whereas on the inside of the stripe 47 that layer F is very thin to achieve a fine and permeable surface 13. As is evident the sealing stripe 47 may assist in efficient building of different kind of layers on the outside and inside respectively thereof 47. Moreover it is evident that the latter kind of functionality may be achieved by using a pre-fabricated frame portion (not shown) which is impermeable and to position that frame portion into the basic mould (not shown), to thereafter use powder to produce the inner permeable body 11 of the mould 20.

The heating means 40 are preferably placed close to the outer moulding surface 13 for good heat transfer to the moulding surface. How close is dependent on the geometry of the pulp mould 10. Preferably though the heating element has at least one active section thereof located at a distance within 20 mm from lowest portion of the moulding surface, preferably within 10 mm, even more preferred within 5 mm.

In FIG. 7 the heating means 40 is shown to be arranged substantially in one level within the central part of the porous body 11, while in FIG. 6 the heating means 40 is arranged substantially in two levels within the central part. It may be possible in simple geometries to let the heating elements follow the contour of moulding surface 13.

Figure 9:
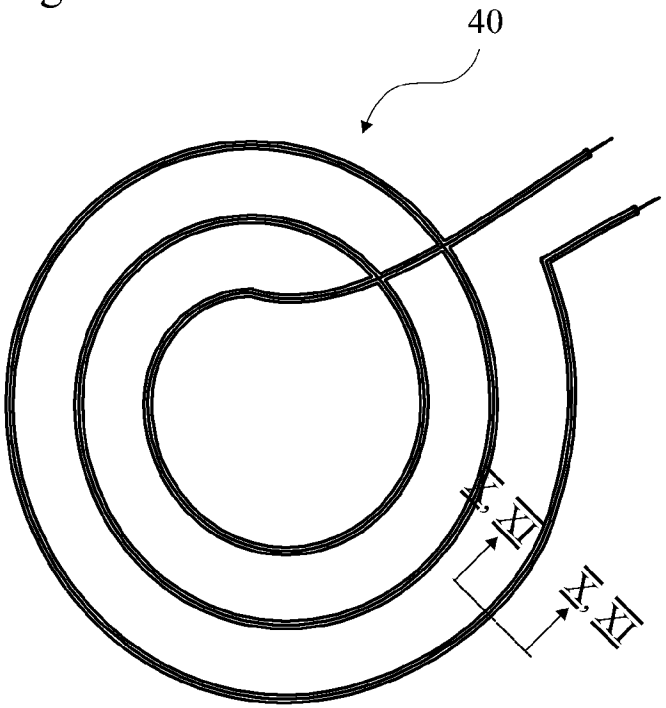
FIG. 9 shows an exemplary embodiment of a heating devise according to the invention.

The heating means in the form of heating coils 40 may of course be wound in different shapes before sintering them into the porous body 11. For instance they may be wound in a circular manner as shown in FIG. 9 or in meander patterns as shown in FIGS. 6 and 7, but of course there are numerous ways of winding the heating elements.

By having the heating means 40 embedded in the porous body 11 much less energy needs to be used to achieve the same temperature at the moulding surface 13 in comparison to the use of a heat plate below the mould as known prior art. Further since the heat plate may be eliminated the pulp moulds may be positioned closer to the rotational centre of the pressing tools 4 which has several advantages: 1) the strike distance may be increased or each mating pressing tools 4 may be placed closer to one another maintaining the same strike distance, 2) the momentum required to rotate the pressing tools 4 is reduced since the weight distribution is moved closer to their rotational centre, thereby enabling a faster rotation and/or a rotation at lower power needs. Further since less energy is used less heat will also reach the machinery of the pressing tools 4. It may therefore be possible to further decrease the heat insulation plate as well as eliminate possible cooling element without risking undue heating of the machinery of the pressing tools, providing even better weight distribution.

Thanks to the new kind of heating element drastic savings may be achieved, especially due to the fact that the new kind of heating means can be used in the form of standard equipment that is very cheaply produced in connection with stoves etc. Also thanks to the embedding thereof, by means of the sintering and eliminating any need of machining in connection with the heating elements, will all lead to considerable cost savings. Further, the improved permeability will give the advantage that in most cases there may not longer be any need for providing broader drainage channels through the porous body 11. However such drainage channels, which e.g. is described in WO2006/057609 and hereby incorporated by reference, may be used to further increase drainage through the pulp mould, e.g. drainage channels running from the inner surface 12 towards the outer surface 13, preferably with decreasing diameter in the direction to the outer surface 13. The new principle of merely machining the portion of the inner surface 12 will also lead to an increase of the production capacity since the reduced amounts of machining will merely take a fraction of the time compared to today's technology.

The elimination of the backing plate between vacuum box and the tool also leads to considerable savings since for instance such a backing plate will need a large number of drill holes, etc.

The invention is not limited by what is described above but may be varied within the scope of the appended claims. For instance for the skilled person it is evident that many different kind of heating means may be used to achieve the desired heating of the mould phase itself, i.e. a variety of the heating devises know per se which may be embedded into the sintered body in accordance with the invention. In the same manner it is evident for the skilled person that a variety of sensors may be integrated into the sintered body. More over it is evident that many of the different features described above, e.g. the none grinding of the back side of the mould, the separate arrangement for achieving good sealing within the attachment area of the mould (eliminating leakage through the screw holes), etc. may be the subject for divisional separate applications in the future. Further, to facilitate heat transfer from the outer layer 400 of the heating means to the porous body 11 of the pulp mould 10, 20, the surface of the outer layer 400 may be roughened and/or to have finer metal powder particles adjacent to the heating means 40, to thereby enhance a sintering neck formation between the heating means 40 and the porous body.

The invention claimed is:

1. A pulp mould, comprising:

a porous sintered body having an outer permeable surface and an inner permeable surface;

a sealing stripe arranged within the porous sintered body such that within the porous sintered body a portion that is impermeable to vacuum and a portion that is permeable to vacuum is formed, wherein the sealing stripe is arranged with at least one through hole; and a heating coil arranged within the portion of the porous sintered body that is permeable to vacuum, the heating coil comprising:

an inner layer that is configured to be heated by electrical resistance;

an intermediate layer surrounding the inner layer, the intermediate layer comprising a lower portion that forms a heat insulator and an upper portion that forms a heat conductor to conduct heat from the inner layer to the porous sintered body; and an outer layer surrounding the intermediate layer and sintered to the porous sintered body to transfer heat to the porous sintered body.

2. The pulp mould of claim 1, wherein the sealing stripe is arranged between the portion of the porous sintered body that is impermeable to vacuum and the portion of the porous sintered body that is permeable to vacuum.

3. The pulp mould of claim 2, wherein the sealing stripe comprises a material that will at least partly bond to the porous sintered body and wherein the thickness thereof is between 0.1-5 mm, preferably 0.5-3 mm.

4. The pulp mould of claim 2, wherein the sealing stripe is open ended, and wherein the ends of the sealing stripe are arranged in contact with each other.

5. The pulp mould of claim 1, wherein the portion of the porous sintered body that is made impermeable to vacuum by the sealing stripe further comprises a layer of sintered powder particles closer to the surface of the portion, and wherein the sintered powder particles comprise fine sintered powder particles.

6. The pulp mould of claim 1, wherein the portion of the porous sintered body is arranged by means of a portion of solid material that is integrated with the porous sintered body during sintering.

7. A method for producing a pulp mould comprising:

providing a porous sintered body having an outer surface and an inner surface;

dividing the porous sintered body by a sealing barrier embedded within the porous sintered body such that a portion of the porous sintered body is made impermeable to vacuum by the sealing barrier;

providing at least one through hole in the sealing barrier; and providing a heating element within a portion of the porous sintered body that is permeable to vacuum, the heating element comprising:

an inner layer that is configured to be heated by electrical resistance;

an intermediate layer surrounding the inner layer, the intermediate layer comprising a lower portion that forms a heat insulator and an upper portion that forms a heat conductor to conduct heat from the inner layer to the porous sintered body; and an outer layer surrounding the intermediate layer and sintered to the porous sintered body to transfer heat to the porous sintered body.

8. The method of claim 7, wherein dividing the porous sintered body by a sealing barrier comprises: arranging a sealing barrier between the portion of the porous sintered body that is impermeable to vacuum and the portion of the porous sintered body that is permeable to vacuum.

9. The method of claim 8, wherein the sealing barrier comprises a material that will at least partly bond to the porous sintered body and wherein the thickness thereof is between 0.1-5 mm, preferably 0.5-3 mm.

10. The method of claim 8, wherein the sealing barrier is open ended and wherein said ends are arranged to be in contact with each other.

11. The method of claim 7, wherein a surface of the portion that is impermeable comprises a layer of fine sintered powder particles.

12. The method of claim 7, further comprising arranging the portion of the porous sintered body by means of a portion of solid material that is integrated with the porous sintered body during sintering.

13. The pulp mould of claim 1 wherein machining of a rear surface of the porous sintered body to form a flat surface is confined to a portion of the rear surface that is to be coupled to a tool plate.

* * * * *